United States Patent [19]

Johnson, Jr.

[11] Patent Number: 5,022,202

[45] Date of Patent: Jun. 11, 1991

[54] HIGH STRENGTH POST FRAMED ENCLOSURE

[76] Inventor: Alfred E. Johnson, Jr., 9812 Satterfield Dr., Little Rock, Ark. 72205

[21] Appl. No.: 520,844

[22] Filed: Jul. 2, 1990

Related U.S. Application Data

[63] Continuation of Ser. No. 214,596, Jun. 24, 1988.

[51] Int. Cl.[5] ..... E02D 27/00

[52] U.S. Cl. ..... 52/169.6; 52/79.1; 405/243

[58] Field of Search ..... 52/169.6, 169.1, 79.1; 405/210, 195, 185, 11, 239, 243; 27/DIG. 1, 2

[56] References Cited

U.S. PATENT DOCUMENTS

| | | | |
|---|---|---|---|
| 4,077,170 | 3/1978 | Van der Lely | 52/79.1 |
| 4,099,353 | 7/1978 | Blunt | 52/169.6 X |
| 4,488,392 | 12/1984 | Pearcey et al. | 52/169.6 X |
| 4,539,780 | 9/1985 | Rice | 52/169.6 |

*Primary Examiner*—Henry E. Raduazo
*Assistant Examiner*—Lan Mai

[57] ABSTRACT

The high strength post framed enclosure provides a subsurface mechanical room or work area that is dust free, waterproof and electrically insulated. The strong outer skin conforms to the structural frame when placed under pressure and creates a lightweight composite structural system to protect the enclosure.

3 Claims, 2 Drawing Sheets

FIGURE 2-A

HIGH STRENGTH POST FRAMED ENCLOSURE

This application is a continuation, of application Ser. No. 07/214,596, filed June 24, 1988 now abandoned.

BACKGROUND OF THE INVENTION

1. Field of the Invention

This invention will apply in a technical field of fiber optics and micro-instrumentation using semi-conductors and computer chips where a controlled environment is necessary in obtaining efficient operation in communication or transmitting commands. The invention is designed to be placed underground or underwater and provide an electro static free, non-conducting rigid interior working compartment for housing of delicate communication and instrumentation systems.

2. Description of the Prior Art

The existing technology consists of either precast concrete vaults or cast-in-place sub-surface concrete structures. These structures tend to sweat inside, crack, and allow water or ground water to enter the facility and have a chalk or dust from the concrete when activity is performed within the structure. All of these items are not compatible with sensitive working communication and instrumentation equipment. These units are extremely heavy, clumsy and difficult to maintain. There is always the risk that exposed reinforcing steel or anchor bolts, either on the surface or as a result of cracked concrete, will serve as a conductor'and short out the sensitive equipment. Installation of equipment on the concrete walls is difficult and jeopardizes the integrity of the structure.

SUMMARY

The high strength post framed enclosure utilizes a rigid steel frame placed inside a pre-formed outer shell constructed of high strength flexible material such as reinforced plastic or laminated fiberglass. The steel frame, by being placed after the formation of the walls and bottom, can be insulated either by a non-conductive material or by insulated material placed on the bearing surface where the steel frame comes in contact with the flexible outer shell.

The interior working surfaces are placed inside the rigid structural steel frame, thereby providing the equipment installer with smooth, sturdy, static and corrosion-free working surfaces The top of the enclosure is placed after the interior walls and floor have been installed and sealed with an epoxy or resin specified to adhere to the materials contained in the outer shell. If conditions dictate, air conditioner, dehumidifier or forced air vent can be formed into the top to regulate the interior environment.

There are no bolts, clips, or fasteners between the structural frame and the outer shell. The walls of the outer shell are slightly tapered to provide ease of removal of the shell from its form and to allow easy placement of the rigid structural steel frame. The interior walls can be as specified by the installer.

The advantages of this invention over existing art are: It is lightweight, easy to install and uses no bolts, fasteners or clamps. The interior is free of any concrete dust. Thermal insulating can be achieved by blowing a compressible media between the shell and interior walls The interior walls are rigid and not affected by exterior wall deflections. There is a watertight enclosure in which the entire work area is insulated and free from any static or electrical charge that might be present in the exterior surrounding.

BRIEF DESCRIPTION OF THE DRAWINGS

FIG. 2 shows the assembly process for constructing the framed enclosure.

DESCRIPTION FOR DRAWINGS

Figure 1:
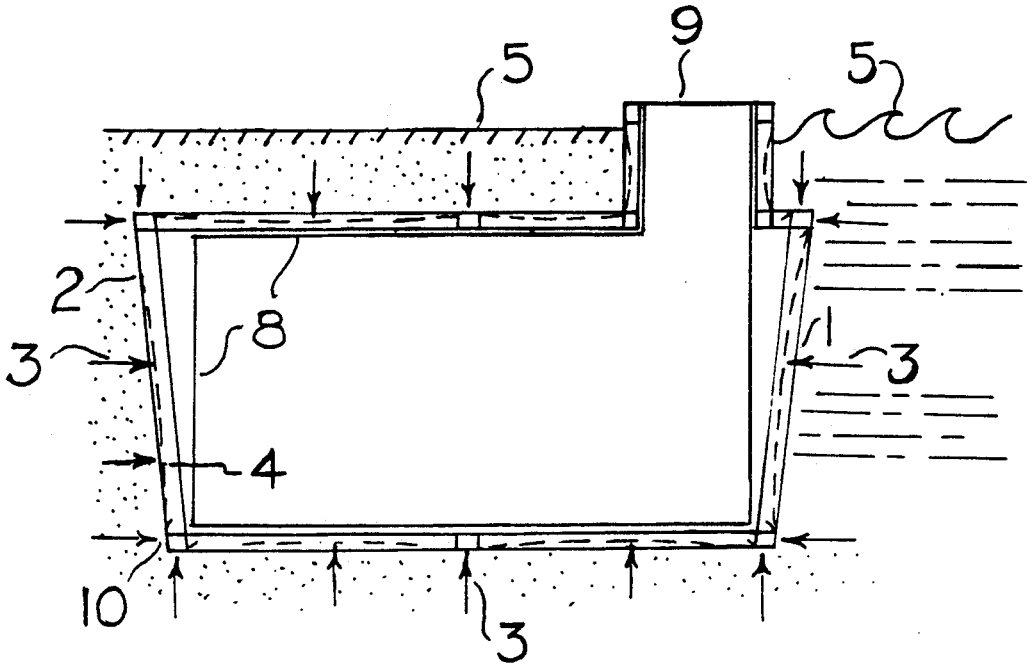
FIG. 1 is the side view of the framed enclosure.

FIG. 1 shows the electrically insulated and protected inner working compartment (8) contained within a reinforced structural steel frame (1) covered with the flexible outer skin (2) installed below ground or water level (5). With the outer skin (2) not bolted or clipped to the frame (1) and insulation coating (10) so that electric current from outside into the working compartment (8) is eliminated. Entry to the working area can be by a hatch (9) or the enclosure can be completely sealed.

Figure 2:
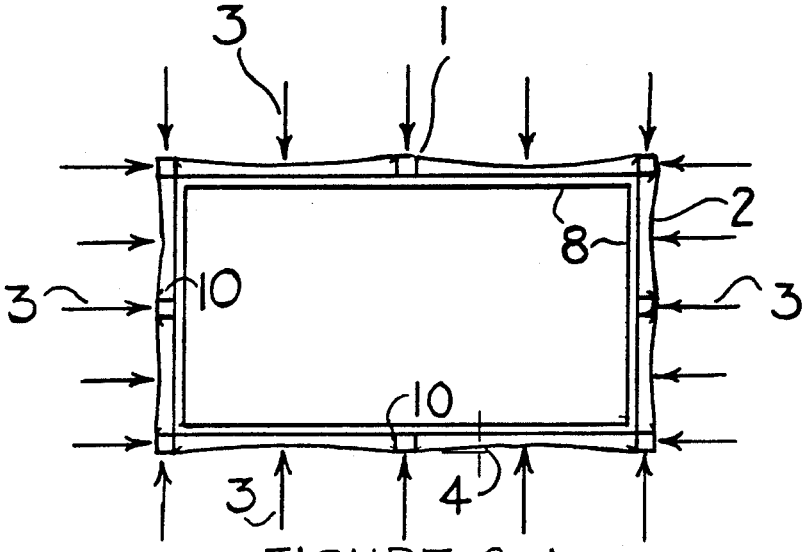
FIG. 2-A shows the stress diagram on the exterior skin of the framed enclosure.
Figure 2:
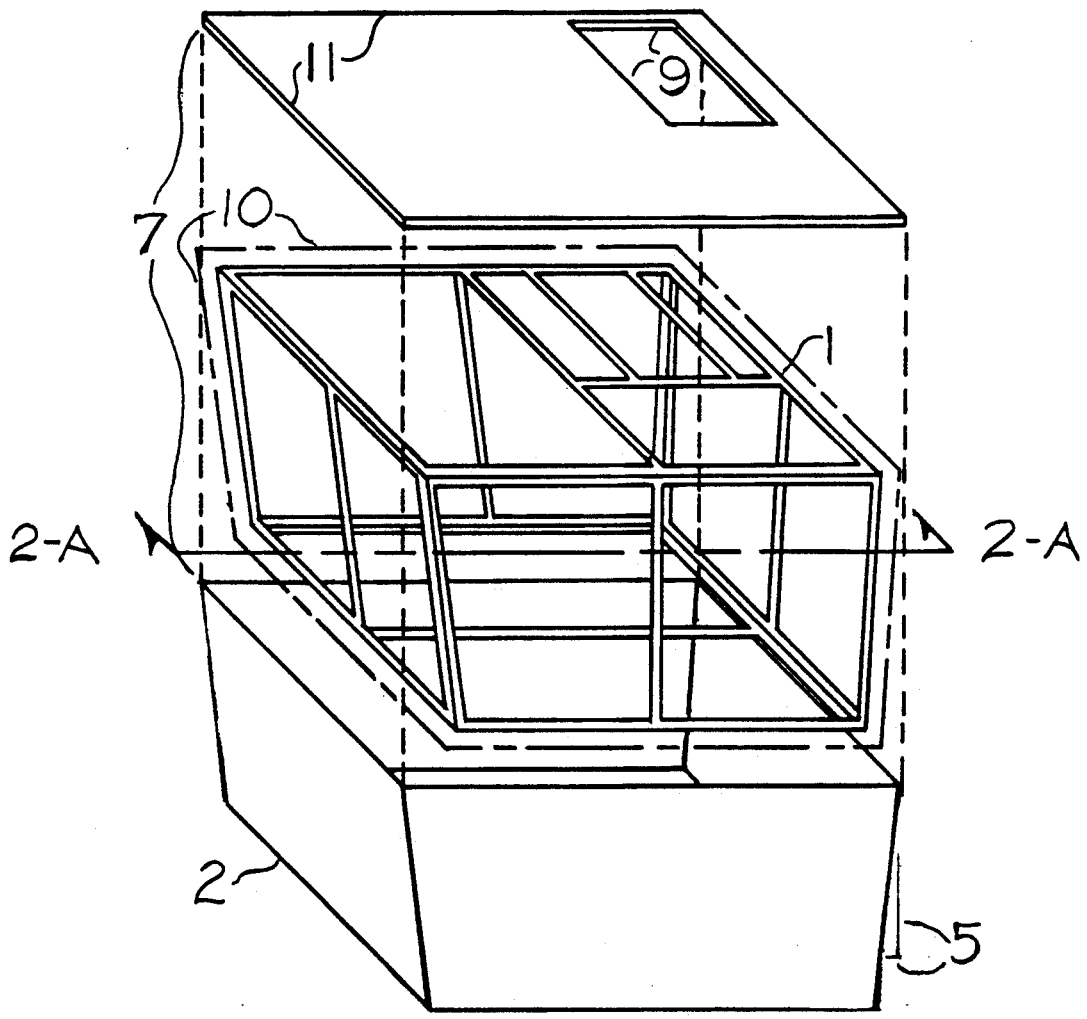

FIG. 2 is a design schematic depicting the structural steel frame (1) support for the outer skin (2). The spacing on the steel frame members can be computed to counter increased hydrostatic pressure (3) and minimize skin deflections (4) as shown in FIG. 2-A. Further, by not having the structural frame affixed to the skin, the materials can have different coefficients of expansion and continue to function without experiencing separation on loading. (Note that the side members of the structural steel frame can be formed with tapered (5) walls for ease of pulling from the mold.) Electrical insulation (10) is placed between the shell and frame or on the frame.

Shown is the assembly process for constructing the high strength post framed enclosure. The assembly can be done without using any bolts, fasteners, or glue to bond the outer surface with the steel frame to develop a composite structural system. The outer skin (2) is formed over a mold and the reinforced steel frame (1) placed inside. The top of the skin (11) is bonded (7) to the molded skin by adhesive or weld. The composite structural strength results when the hydrostatic or soil pressure (3) presses the outer skin against the structural frame.

The exterior surface skin (2) of this enclosure which is formed on a mold can be constructed of a variety of materials any of which can withstand moment deflection but have high tensile strength. The recommended materials are laminated fiberglass similar to that used in normal boat construction or a reinforced plastic using a fiberglass mesh as the reinforcing. It would be possible to make the outer surface from a non-corrosive metal such as a thin sheet of stainless steel. The selection of the outer surface will be depending upon the environmental conditions under which the enclosure must serve.

The structural frame (1) will most probably be welded and painted epoxy-coated structural steel.

I claim:

1. An enclosure capable of withstanding high exterior pressures comprising a lightweight water-tight outer shell, a rigid structural steel frame cage placed inside said outer shell and interior walls located inside said steel frame, the outer shell is not directly affixed or bonded to the steel frame whereby exterior pressures cause deflection of the outer shell to press against the steel frame allowing the outer shell and steel frame to function as a composite unit that is of sufficient strength to prevent deformation of the interior walls.

2. The enclosure of claim 1 wherein there are no fasteners, rivets, or bolt between the steel frame and the outer shell.

3. The enclosure of claim 1 wherein the outer shell is non-conductive or has an insulated coating to prevent electrolysis.

* * * * *